US006558187B2

(12) United States Patent
Aoki

(10) Patent No.: US 6,558,187 B2
(45) Date of Patent: May 6, 2003

(54) CONNECTOR FOR FLAT CIRCUIT MEMBER

(75) Inventor: Hiroshi Aoki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/079,869

(22) Filed: Feb. 22, 2002

(65) Prior Publication Data

US 2002/0142647 A1 Oct. 3, 2002

(30) Foreign Application Priority Data

Feb. 22, 2001 (JP) ..... 2001-046847

(51) Int. Cl.[7] ..... H01R 12/24
(52) U.S. Cl. ..... 439/496
(58) Field of Search ..... 439/496, 246, 439/495, 67, 77

(56) References Cited

U.S. PATENT DOCUMENTS 3,696,319 A * 10/1972 Olsson ..... 439/496
5,194,017 A 3/1993 Consoli
5,451,172 A 9/1995 Lee Siew Suan et al.

FOREIGN PATENT DOCUMENTS

EP 0 743 715 A2 11/1996

* cited by examiner

*Primary Examiner*—Gary Paumen
(74) *Attorney, Agent, or Firm*—Sughrue Mion, PLLC

(57) ABSTRACT

A flat circuit member connector (21) includes electrical connection terminals (29) received and held in a terminal receiving portion (31*a*) of a connector housing, and a holder (26) which holds an electrical contact portion (24) of an FPC, wound around its flat insertion plate portion (25*a*), and can bring conductors of the electrical contact portion into contact with the electrical connection terminals (29), respectively. The electrical connection terminal includes a holding portion (29*a*) for holding the electrical contact portion, wound around the flat insertion plate portion, when the holder is inserted into the connector housing. The holding portion is received in the terminal receiving portion, with clearances (C1 and C2) formed between the holding portion and an inner wall of the terminal receiving portion, so that the holding portion can be pivotally displaced in a holding direction.

10 Claims, 10 Drawing Sheets

CONNECTOR FOR FLAT CIRCUIT MEMBER

BACKGROUND OF THE INVENTION

This invention relates to a connector for a flat circuit member, and more particularly to a flat circuit member connector in which an electrical contact portion, formed at an end portion of a flexible flat circuit member, is wound around a front end portion of a holder, and the front end portion of this holder is fitted and inserted into a terminal receiving portion of a connector housing, thereby electrically connecting conductors respectively to electrical connection terminals held in the terminal receiving portion.

FIG. 7 shows a related connector for a flat circuit member.

In the state that a connector connection portion (electrical contact portion) 3, formed at an end portion of a rigid flat circuit member in the form of a printed circuit board 2, is inserted into a slit-like terminal receiving portion 6 of a connector housing 5 of this flat circuit member connector 1, resilient contact piece portions 8*a* of a plurality of pairs of opposed electrical connection terminals 8, 8, provided within the terminal receiving portion 6, hold the connector connection portion 3, and conducting portions (conductors) 11, provided at the connector connection portion 3, are electrically connected to the corresponding electrical connection terminals 8, respectively.

Side limitation surfaces 6*a* for abutting against opposite side surfaces of the electrical connection terminals 8 to limit the lateral movement of the electrical connection terminals 8, and rear limitation surfaces 6*b* for abutting against rear surfaces of the electrical connection terminals 8 are formed within the terminal receiving portion 6 of the connector housing 5. The electrical connection terminals 8 are positioned and held against shaking by the side limitation surfaces 6*a* and the rear limitation surfaces 6*b*.

However, in the above flat circuit member connector 1, when the connector connection portion 3 is inserted into the terminal receiving portion 6, this connector connection portion 3, in some cases, is partially contacted hard with the corresponding electrical connection terminals 8, thus causing an excessive rubbing engagement (interference) therebetween.

When such an excessive rubbing engagement occurs, the resilient contact piece portions 8*a* of those electrical connection terminals 8, subjected to the excessive rubbing engagement, are resiliently deformed in a larger amount than those electrical connection terminals 8, not subjected to the excessive rubbing engagement, and the connector connection portion 3 are inserted.

Therefore, the flat circuit member connector 1 varies in the inserting pressure acting on the connector connection portion 3 of the printed circuit board 2, and therefore there is encountered a problem that the operation of inserting the printed circuit board 2 is made difficult.

The resilient contact piece portions 8*a* of part of the electrical contact terminals 8 are excessively deformed because of the excessive rubbing engagement, and as a result the contact positions and contact areas of the resilient contact piece portions 8*a* are delicately varied, thus inviting a fear that the electrical connection characteristics are degraded.

Therefore, there has been proposed a flat circuit member connector 10 as shown in FIG. 8.

In this flat circuit member connector 10, when the connector connection portion (electrical contact portion) 3, formed at the end portion of the rigid printed circuit board 2 (shown in FIG. 7), is inserted into a slit-like terminal receiving portion 13 of a connector housing 12, a plurality of pairs of opposed electrical connection terminals 18, 18, provided within the terminal receiving portion 13, hold the connector connection portion 3, and conducting portions (conductors) 11, provided at the connector connection portion 3, are electrically connected respectively to the electrical connection terminals 18 disposed in opposed relation thereto.

As shown in FIG. 9, the electrical connection terminal 18 is formed by bending a thin metal sheet into a box-like shape, and a mounting pin 14*c* is formed at a lower end thereof, and an upper portion thereof is bent back into a bow-like shape to form a resilient contact piece portion 14*d*. A left side wall 14*a* and a right side wall 14*b* are formed by bending, and generally hold the resilient contact piece portion 14*d* therebetween from opposite (left and right) sides thereof.

Thus, the side walls 14 are formed to cover base portions of the resilient contact piece portion 14*d*, including the bent portion thereof, and an apex portion of this resilient contact piece portion 14*d* projects forwardly (right in FIG. 9) beyond the side walls 14. As top per piece portion 14*e* is formed inwardly of the resilient contact piece portion 14*d* (on the inner side of the side wall 14), and limits the excessive flexing of the resilient contact piece portion 14*d*.

Namely, when an external force acts on the resilient contact piece portion 14*d* in a direction other than a proper flexing direction because of an excessive rubbing engagement of the printed circuit board 2, the movement of the resilient contact piece portion 14*d* is limited by the side walls 14*a*, 14*b*. When a large external force, greater than a predetermined level, acts on the resilient contact piece portion, the movement thereof is limited by the stopper piece portion 14*e*, and by doing so, the deformation of the resilient contact piece portion is prevented.

The above printed circuit board 2 is the rigid flat circuit member. Recently, instead of the printed circuit board 2, there has been used a flexible flat circuit member such as a flexible printed circuit member (hereinafter referred to as "FPC"), having a wiring circuit printed on a film-like, thin flexible insulative substrate, and a flexible flat cable (hereinafter referred to as "FFC").

In the case of using such a flat circuit member such as an FPC and an FFC, there is used a connector for a flat circuit member. In this case, an electrical contact portion formed at an end portion of the flat circuit member is wound around a front end portion of a holder, and the front end portion of this holder is fitted and inserted into a terminal receiving portion of a connector housing, so that electrical connection terminals held in the terminal receiving portion holds conductors on the electrical contact portion, and therefore are electrically connected thereto.

Namely, the electrical contact portion formed at the end portion of the flexible flat circuit member is wound around the front end portion of the holder, and by doing so, the electrical connection terminals, held in the terminal receiving portion, can hold the conductors on the electrical contact portion, and therefore can be electrically connected thereto.

However, even in the case of employing the electrical connection terminals 18 in the flat circuit member connector 10, there is a possibility that the excessive rubbing engagement is caused by a combination of various factors such as delicate inclination of the connector connection portion 3 at the time of insertion into the terminal receiving portion 13, variations in the accuracy of positioning of the electrical connection terminals 18 in the terminal receiving portion 13, and dimensional irregularities of the electrical connection terminals 18.

Namely, when the connector connection portion 3 of the printed circuit board 2 is inserted into the terminal receiving portion 13, a large force, in some cases, acts on this connector connection portion and the left and right side walls 14*a* and 14*b* (formed by bending) and stopper piece portions 14*e* of the electrical connection terminals 18 because of the excessive rubbing engagement. This causes variations in the inserting pressure, acting on the connector connection portion 3, thus inviting a problem that the operation of inserting the printed circuit board 2 is made difficult.

The same problem is encountered with the electrical connection terminals also in the case where the front end portion of the holder, around which the electrical contact portion formed at the end portion of the flat circuit member is wound, is fitted and inserted into the terminal receiving portion of the connector housing, so that the electrical connection terminals, received and held in the terminal receiving portion, hold the conductors on the electrical contact portion, and are electrically connected thereto.

SUMMARY OF THE INVENTION

Therefore, it is an object of this invention to solve the above problems, and more specifically to provide a flat circuit member connector which prevents the deformation of electrical connection terminals, received in a terminal receiving portion of a connector housing, and has good electrical connection characteristics and fitting operability.

In order to solve the aforesaid object, the invention is characterized by having the following arrangement.

(1) A flat circuit member connector comprising:

a connector housing;

a terminal receiving portion provided to the connector housing and including a terminal support portion;

an electrical connection terminal inserted into and received in the terminal receiving portion in an insertion direction, the electrical connection terminal including, a holding portion disposed in the terminal receiving portion so that a clearance for allowing a displacement of the holding portion in a holding direction is formed between the holding portion and the terminal receiving portion, and a fixing portion supported by the terminal support portion and extending from the holding portion in the insertion direction, a flexible flat circuit member including at an end portion thereof an electrical contact portion to which a conductor is exposed; and a holder which holds the flexible flat circuit member which is would around an end portion of the holder, and is held by the holding portion in the holding direction so that the electrical contact portion is electrically connected to the electrical connection terminal when the holder is inserted into the connector housing in the insertion direction.

(2) The flat circuit member connector according to (1), wherein a weak portion for allowing a pivotal displacement of the holding portion in the holding direction is formed between the fixing portion and the holding portion.

(3) The flat circuit member connector according to (1), wherein a plurality of the terminal receiving portions for respectively receiving a plurality of the electrical connection terminals are provided to the connector housing and are aligned in a direction substantially perpendicular to the holding direction.

(4) The flat circuit member-connector according to (1), wherein the holding portion includes a pair of holding pieces for electrical connection with the electrical connection portion, and the holding portion is disposed in the terminal receiving portion so that the clearance is formed between one of the pair of holding pieces and an inner wall of the terminal receiving portion and between the other holding piece and the inner wall of the terminal portion.

In the above construction, the holding portion of electrical connection terminal, received in the terminal receiving portion of the connector housing, can be pivotally displaced in the holding direction about a pivotal point disposed in the vicinity of the fixing portion fixedly supported by the terminal support portion of the connector housing.

Therefore, even if the holder is inclined relative to the holding portion during the time when the front end portion of the holder, around which the electrical contact portion of the flat circuit member is wound, is fitted and inserted into the connector housing, the holding portion can be pivotally displaced in accordance with the direction of insertion of the holder. Therefore, the front end portion of the holder will not cause an excessive rubbing engagement relative to the holding portion.

On the other hand, even when part of the front end portion of the inserted holder is contacted hard with the holding portions of the corresponding electrical connection terminals because of variations in the dimensional accuracy of the electrical connection terminals (received in the terminal receiving portion of the connector housing) and variations in the accuracy of positioning of the electrical connection terminals in the terminal receiving portion, the relevant holding portions can be pivotally displaced in accordance with the direction of the front end portion of the holder, and therefore the front end portion of the holder will not cause an excessive rubbing engagement relative to these holding portions.

Namely, the elimination of the excessive rubbing engagement of the electrical connection terminal is achieved by the pivotal displacement of the holding portion about the pivotal point near to the fixing portion of the electrical connection terminal, and does not depend on the resilient deformation of the holding portion. Therefore, the inserting pressure, required when inserting the front end portion of the holder into the holding portions of the electrical connection terminals, is generally uniform over all of the electrical connection terminals received in the terminal receiving portion, and variations of the inserting pressure due to the excessive rubbing engagement will not occur.

The holding portion of the electrical contact terminal, holding the front end portion of the holder, will not be contacted hard with this front end portion, and therefore will not be excessively deformed, and each holding portion can contact the conductor on the flat circuit member, wound around the front end portion of the holder, within the predetermined resilient-deformation range.

The term "weak portion" means such a portion as a constricted portion and a thinned portion, slightly lower in strength so that it can be easily bent upon application of an external force.

DETAILED DESCRIPTION OF PREFERRED EMBODIMENTS

One preferred embodiment of a flat circuit member connector of the present invention will now be described in detail with reference to the accompanying drawings.

Figure 1:
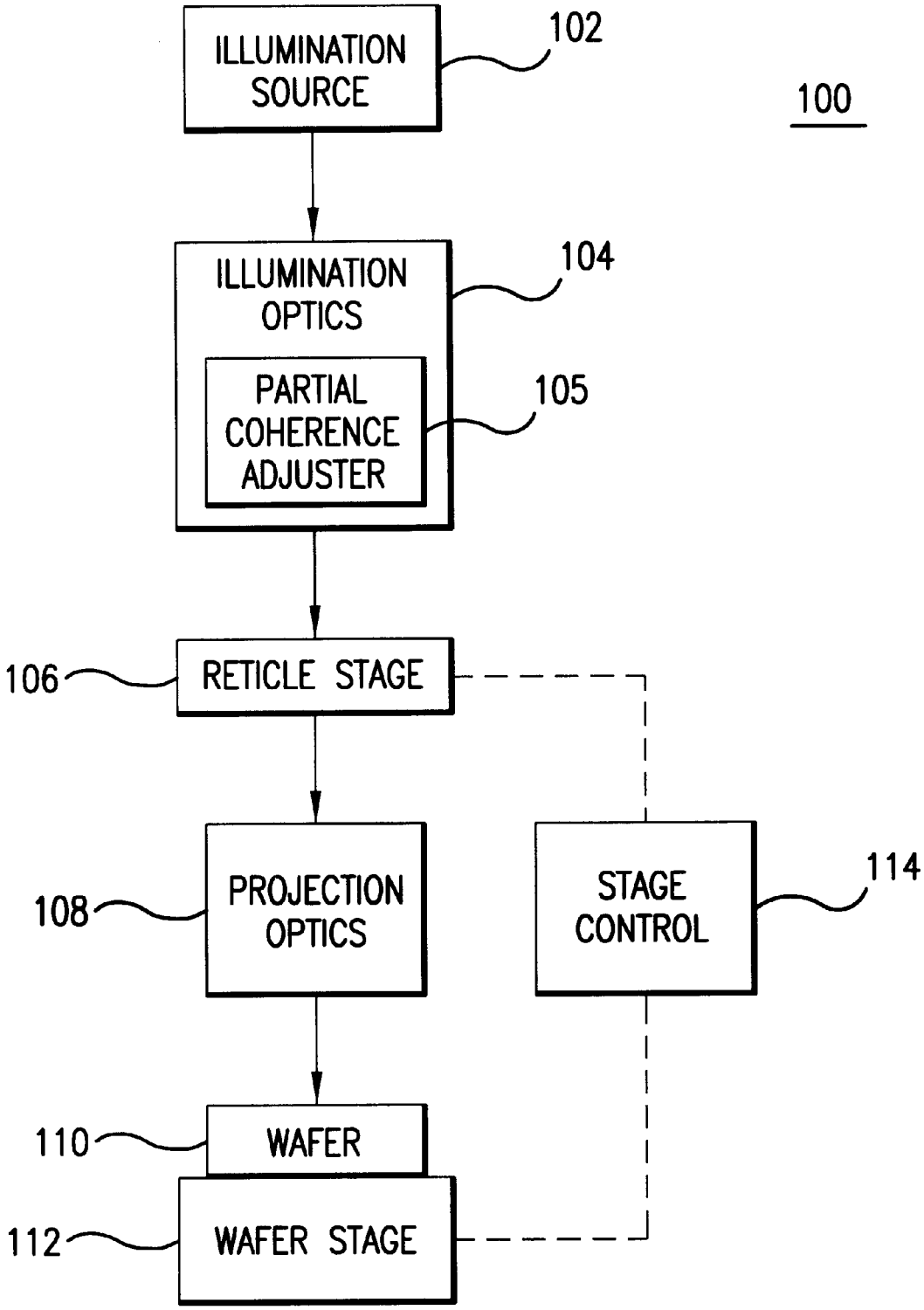
FIG. 1 is an exploded, perspective view of one preferred embodiment of a flat circuit member connector of the invention.
Figure 5:
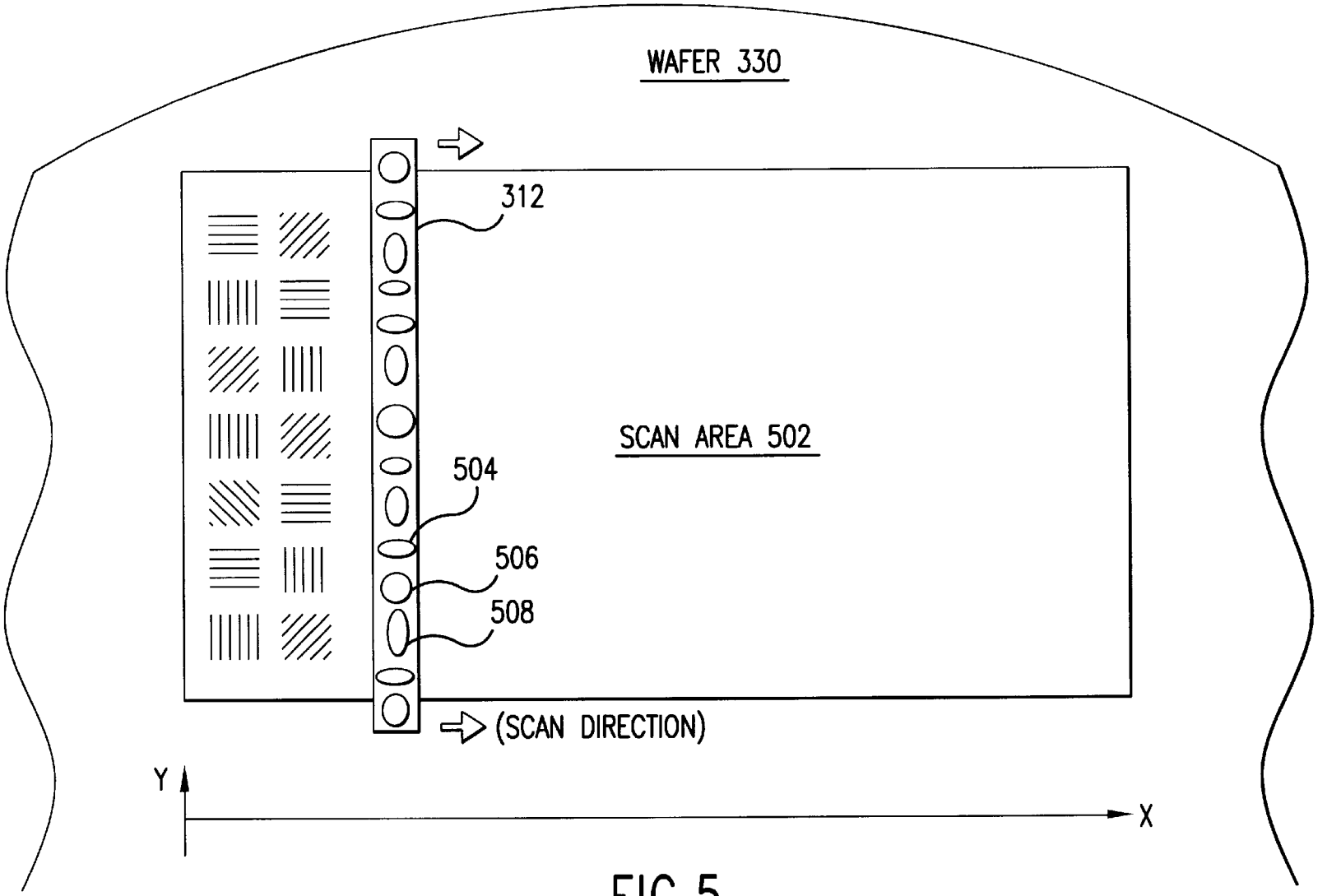
FIG. 5 is an enlarged, perspective view of a connector housing shown in FIG. 1.
Figure 6:
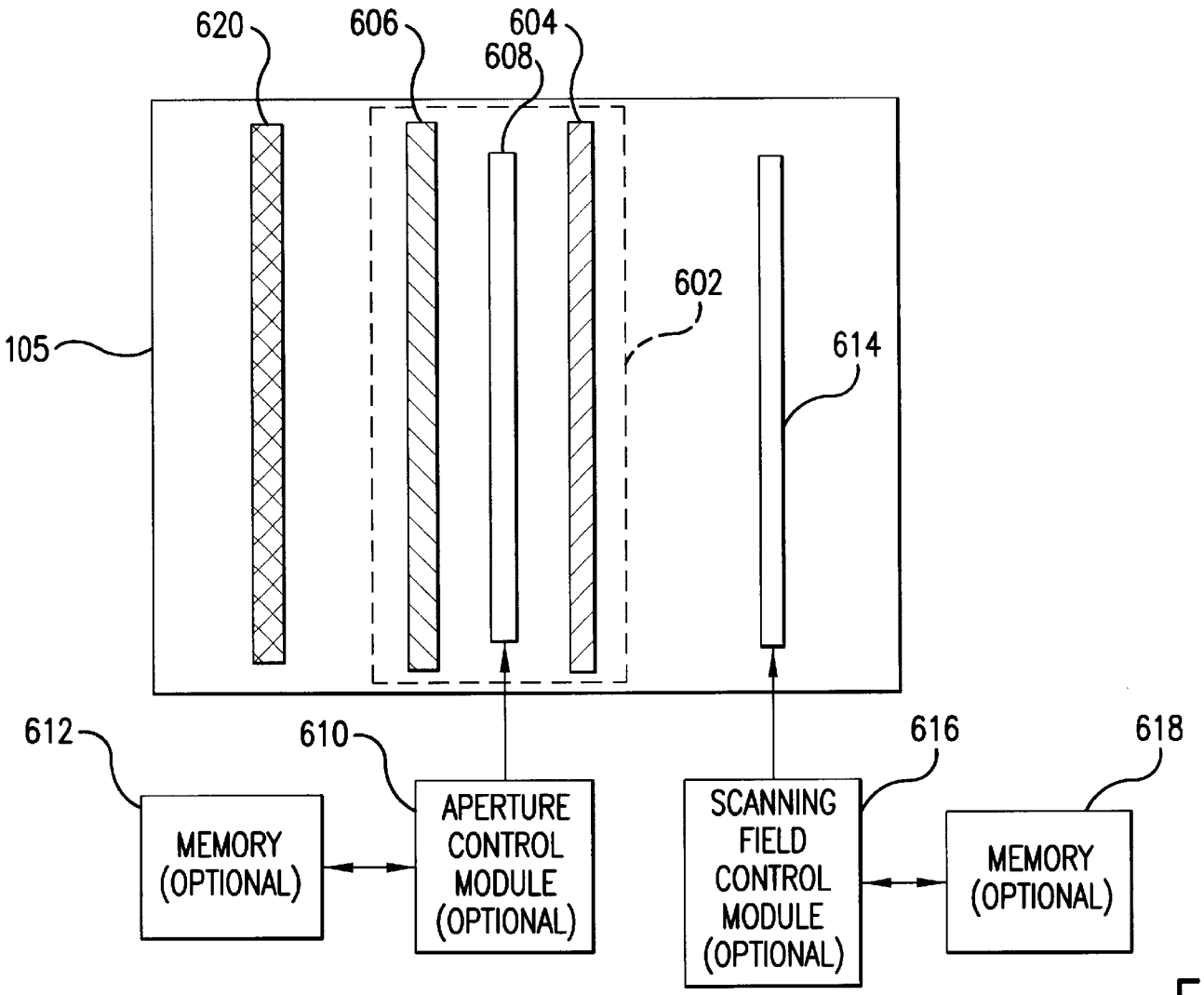
FIG. 6 is a vertical cross-sectional view explanatory of a fitting operation of the flat circuit member connector of FIG. 1.
Figure 7:
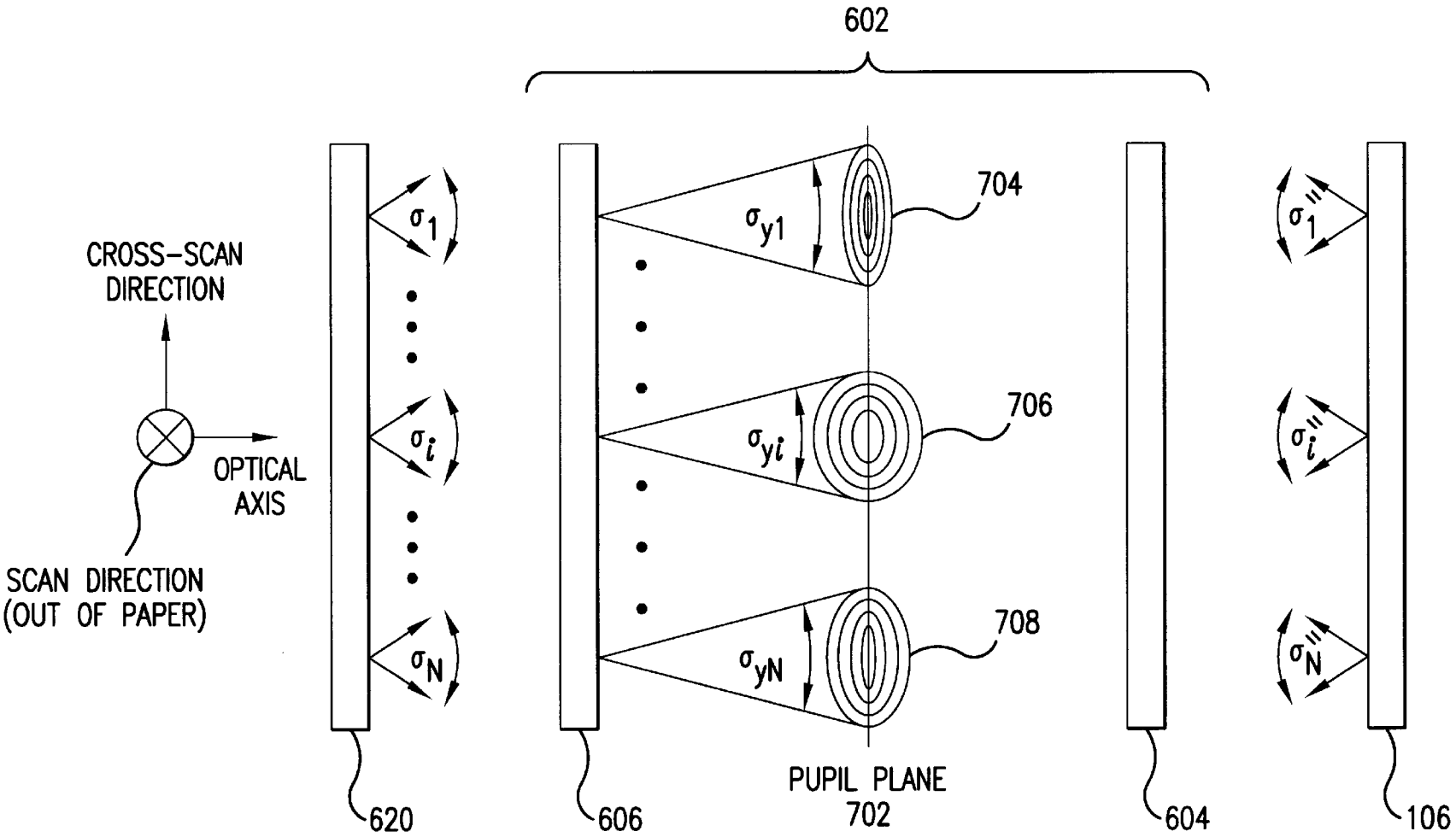
FIG. 7 is an exploded, perspective view of an important portion of a related flat circuit member connector.
Figure 8B:
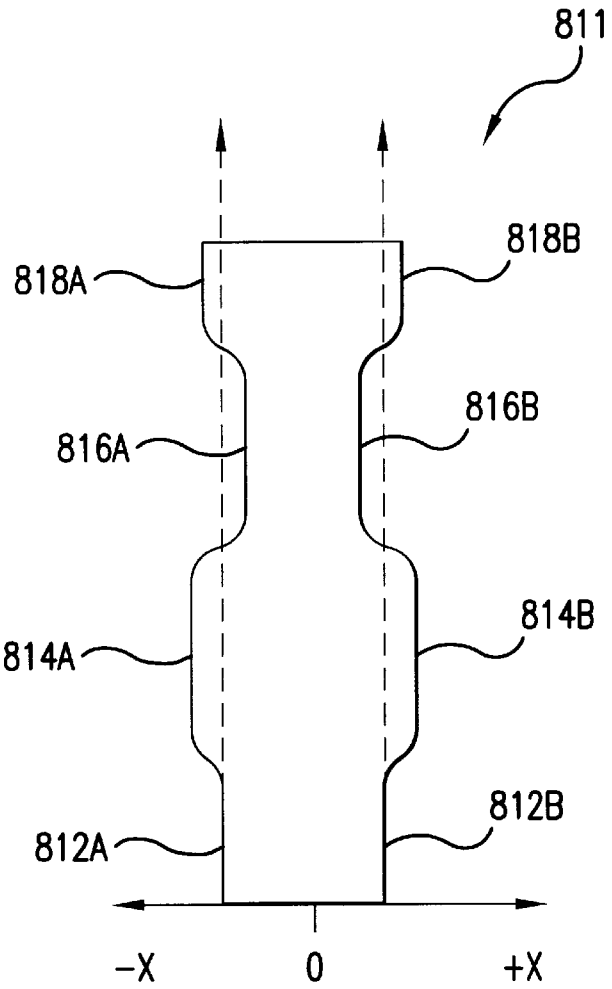
FIG. 8 is a vertical cross-sectional view of another related flat circuit member connector.
Figure 8A:
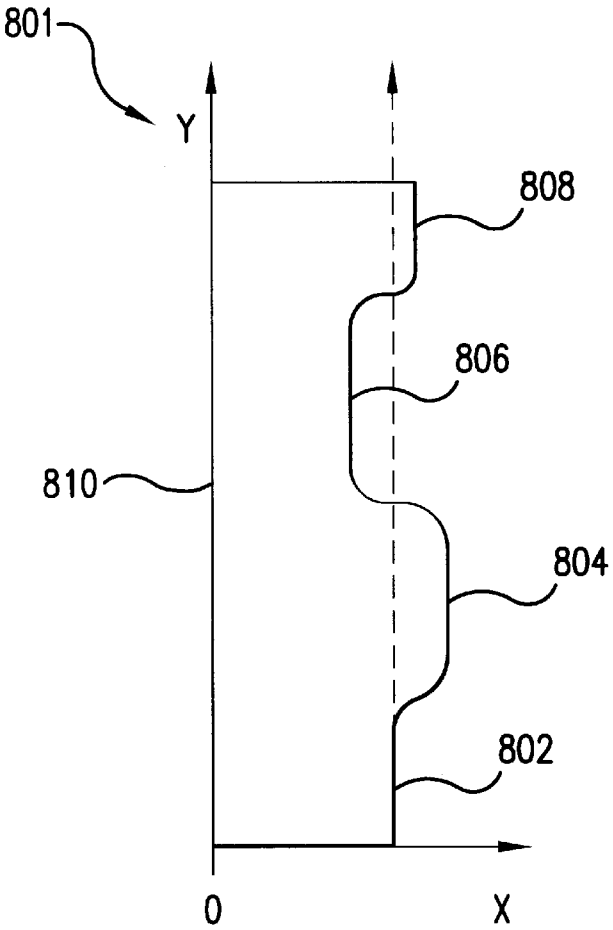
Figure 9A:
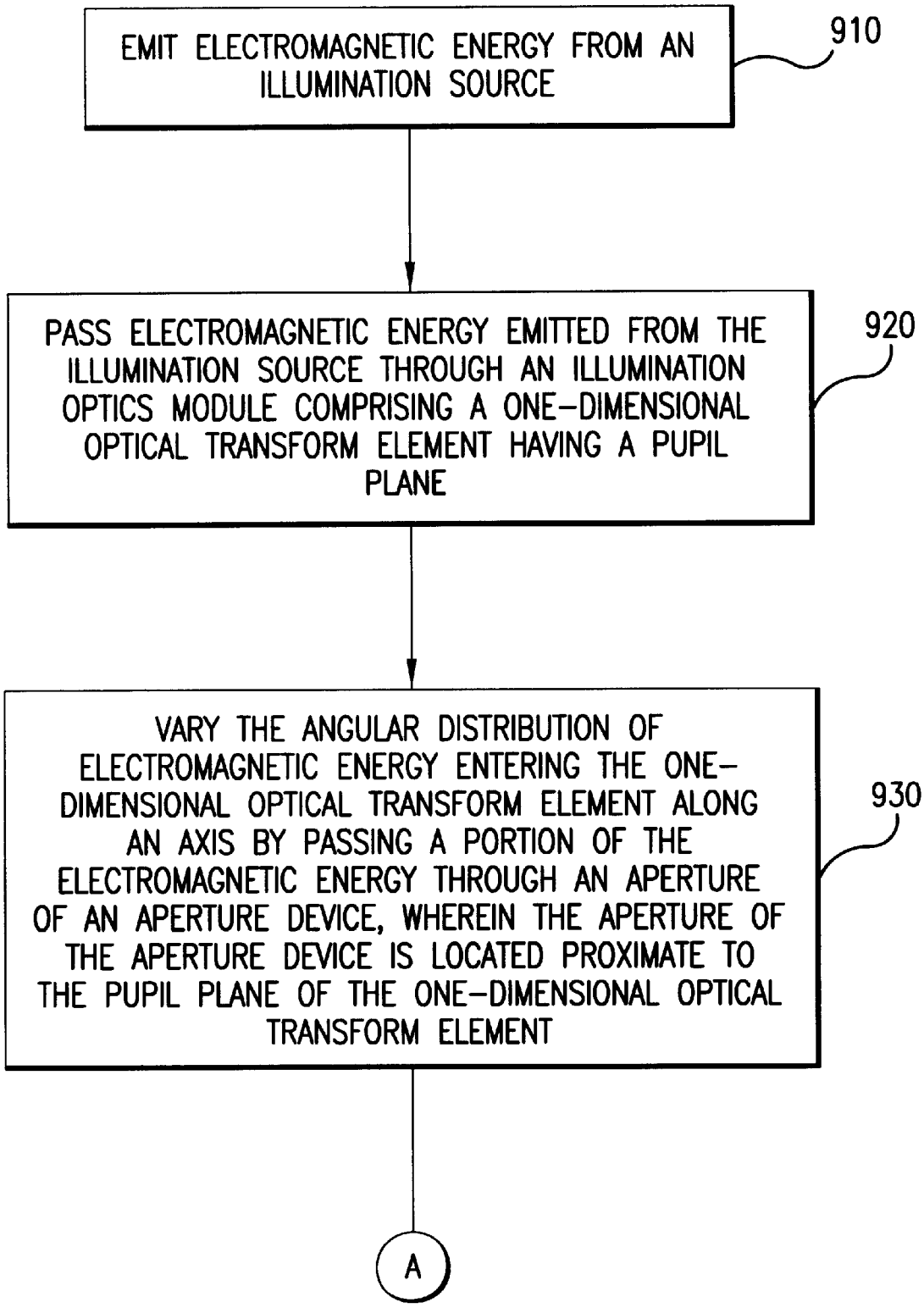
FIG. 9 is a partly-cross-sectional, perspective view of an electrical connection terminal shown in FIG. 8.
Figure 9B:
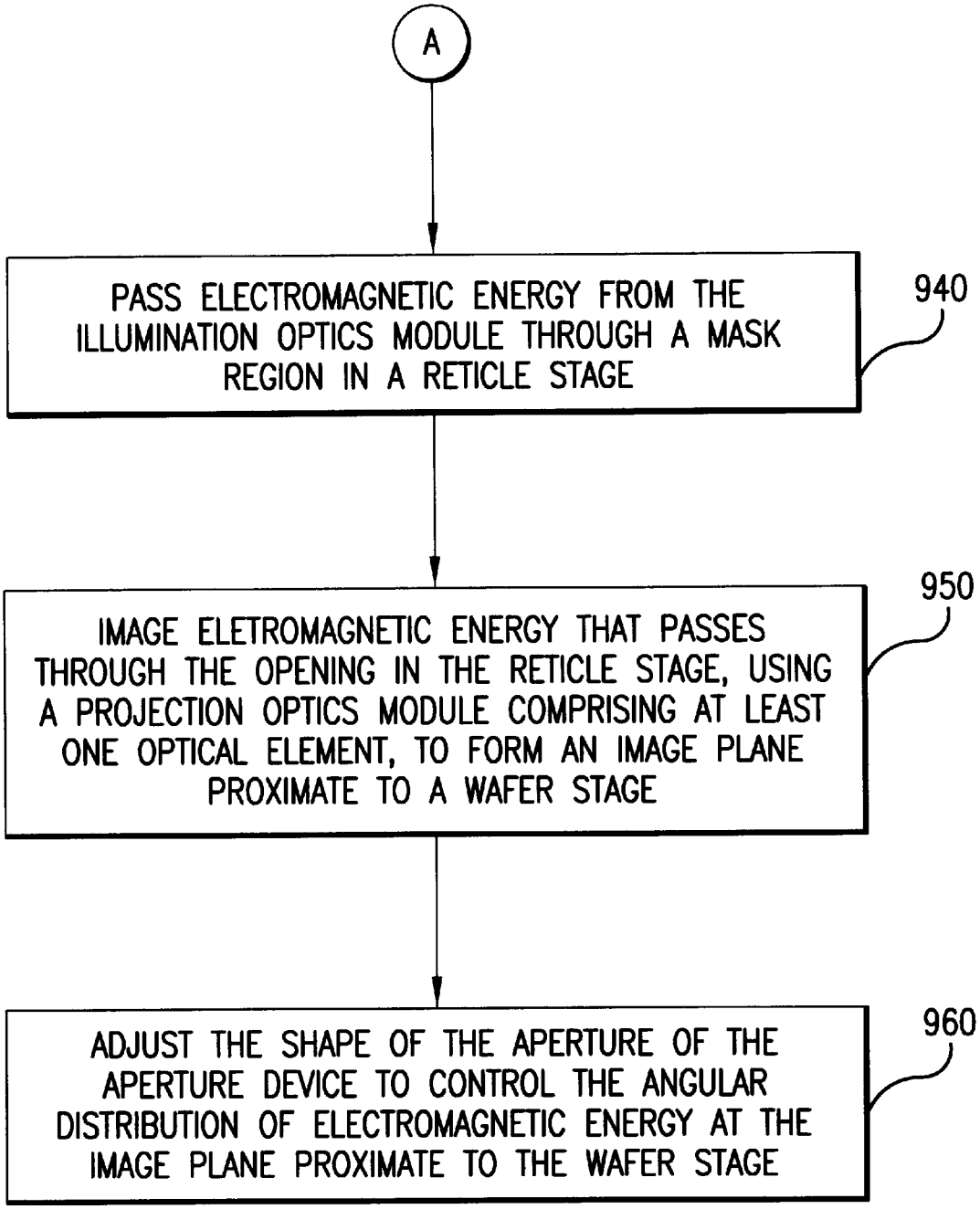
Figure 1:
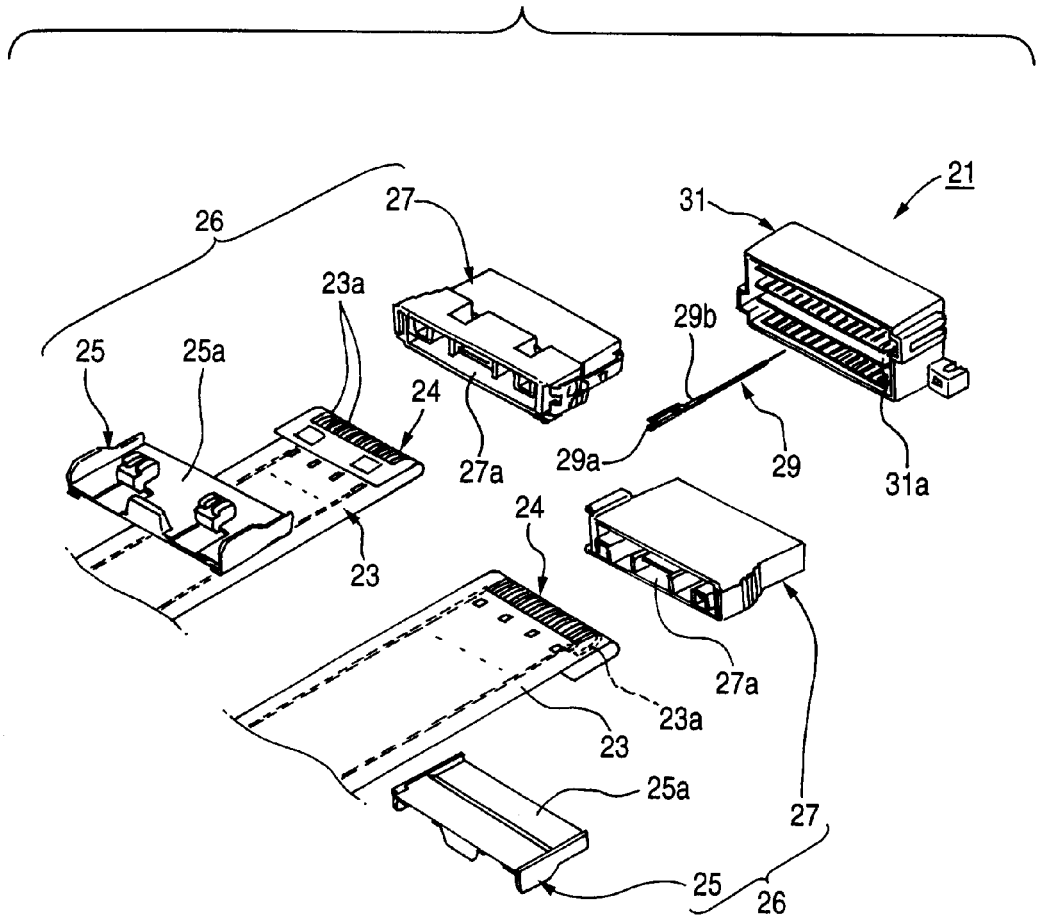
Figure 2:
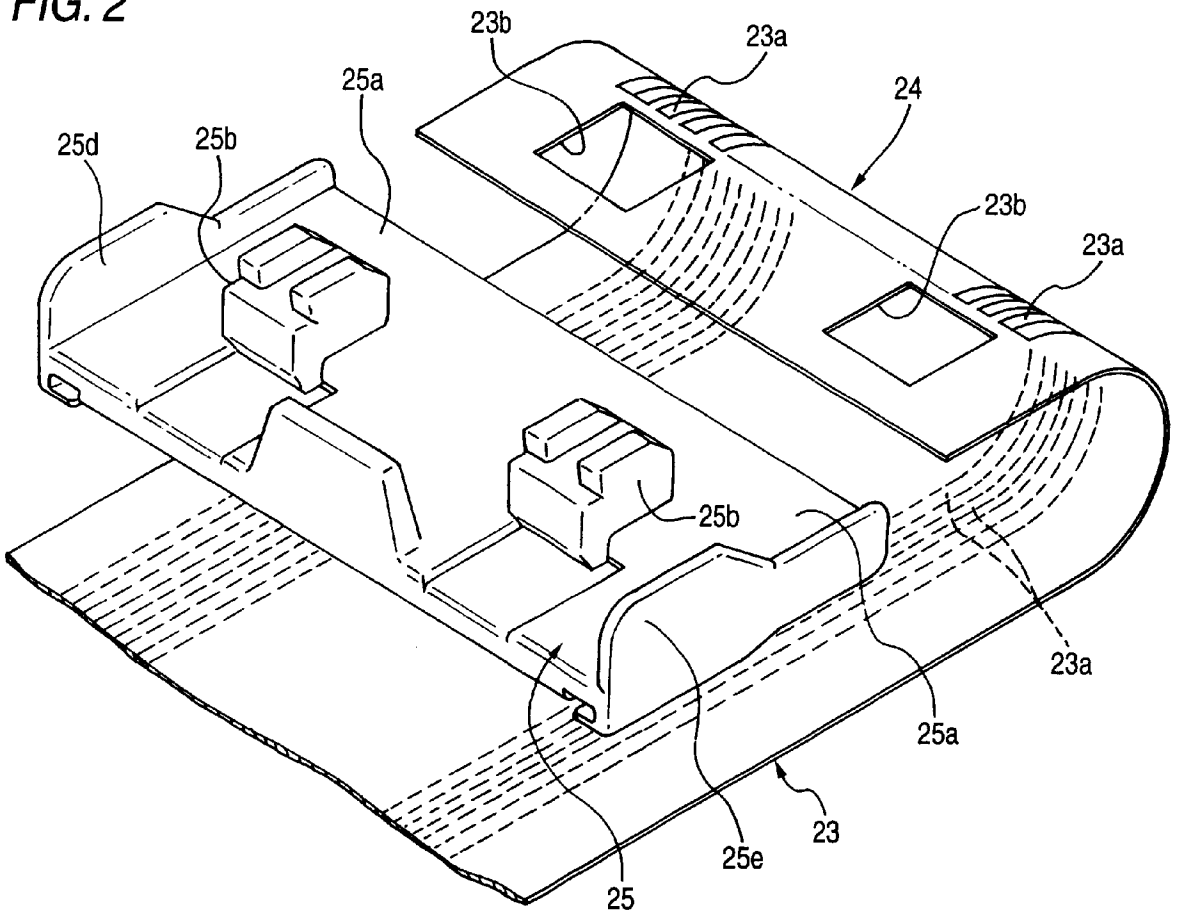
Figure 3:
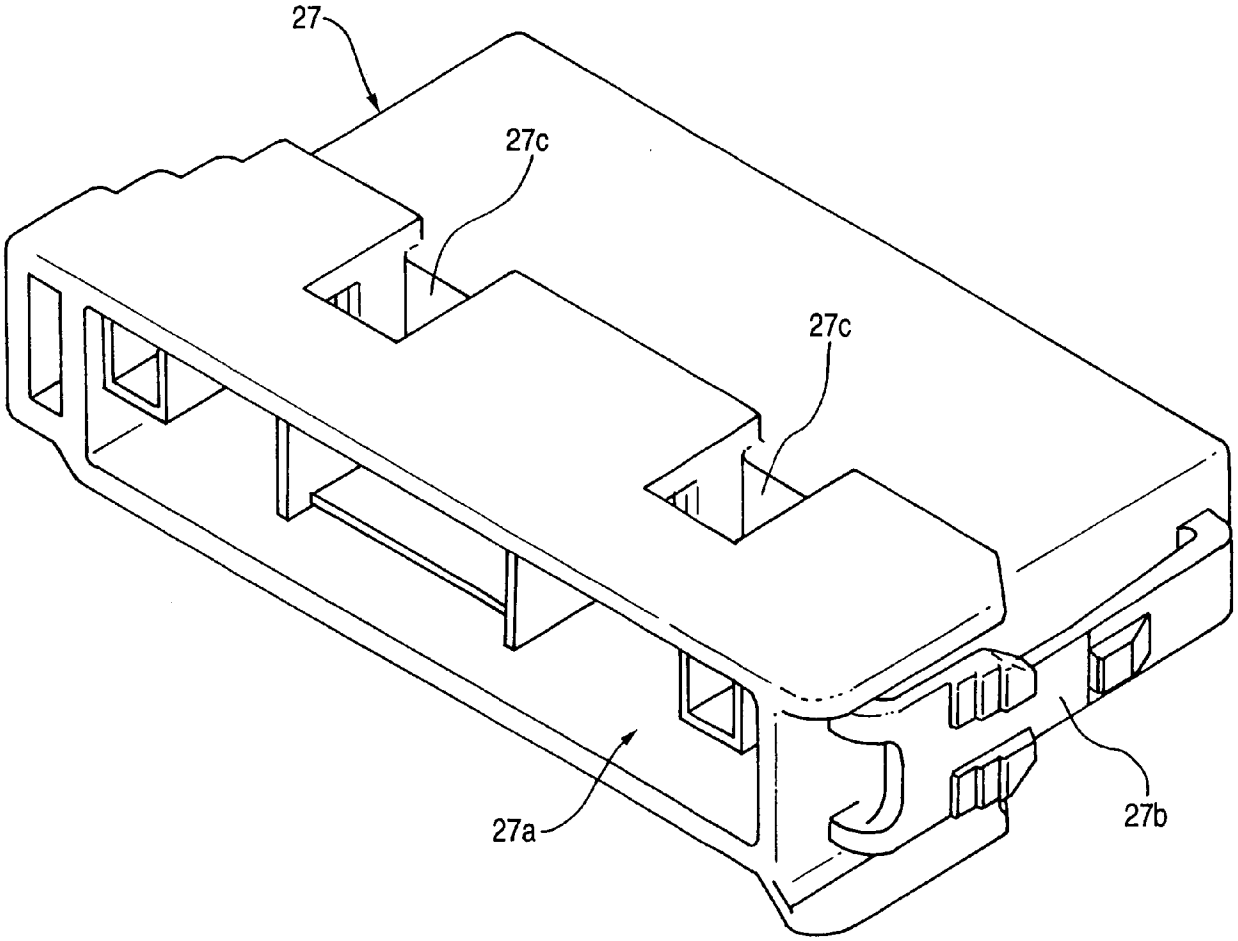

FIG. 1 is an exploded, perspective view of one preferred embodiment of the flat circuit member connector of the invention, FIGS. 2 to 5 are enlarged views of important portions of the flat circuit member connector of FIG. 1, and FIG. 6 is a vertical cross-sectional view explanatory of a fitting operation of the flat circuit member connector of FIG. 1.

As shown in FIG. 1, the flat circuit member connector 21 according to the embodiment is constituted by a connector housing 31, a plurality of electrical connection terminals 29, flexible FPCs (flat circuit members) 23, and holders 26. The plurality of electrical connection terminals 29 are received and held in terminal receiving portions 31*a* of the connector housing 31. The flexible FPCs 23, each includes at its end portion an electrical contact portion 24 to which conductors 23*a* are exposed. The holders 26 each holds the corresponding electrical contact portion 24 wound around a front end portion thereof, and is inserted into the corresponding terminal receiving portion 31*a* of the connector housing 31 in the same direction as the direction of axes of the electrical connection terminals 29 so as to bring the conductors 23*a* of the electrical contact portion 24 into contact with the electrical connection terminals 29, respectively.

As shown in FIG. 1, the holder 26 includes a holder body 25 having an flat insertion plate portion 25*a* around which the electrical contact portion 24 of the FPC 23 is wound, and a holder casing 27 which holds the end portion of the FPC 23 wound around the insertion-purpose flat plate portion 25*a* and is fitted into the terminal receiving portion 31*a* of the connector housing 31.

Figure 2:
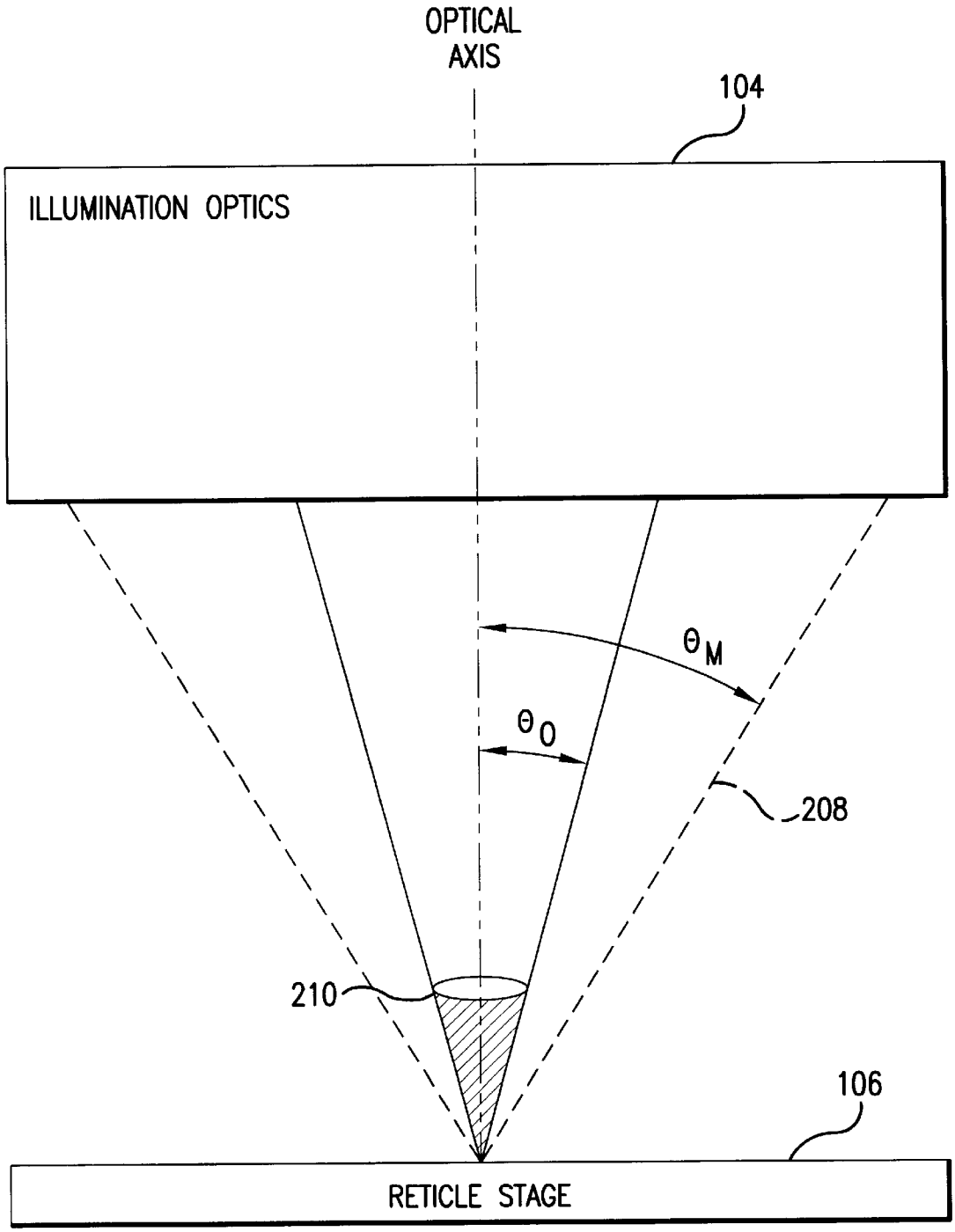
FIG. 2 is an enlarged view of an important portion of the flat circuit member connector shown in FIG. 1.

As shown in FIG. 2, the holder body 25 includes: the flat insertion plate portion 25*a,* having the front end portion around which the electrical contact portion 24 of the FPC 23 is wound; a pair of retaining projections 25*b* and 25*b* formed on an upper surface of the insertion-purpose flat plate portion 25*a;* and side wall portions 25*d* and 25*e* which are formed respectively at opposite side edges of the insertion-purpose flat plate portion 25*a,* limit the lateral movement of the FPC 23, and serve as insertion guides for guiding the insertion of the holder body into the terminal receiving portion 31*a*. This holder body 25 is molded into an integral construction, using an insulative resin.

Figure 3:
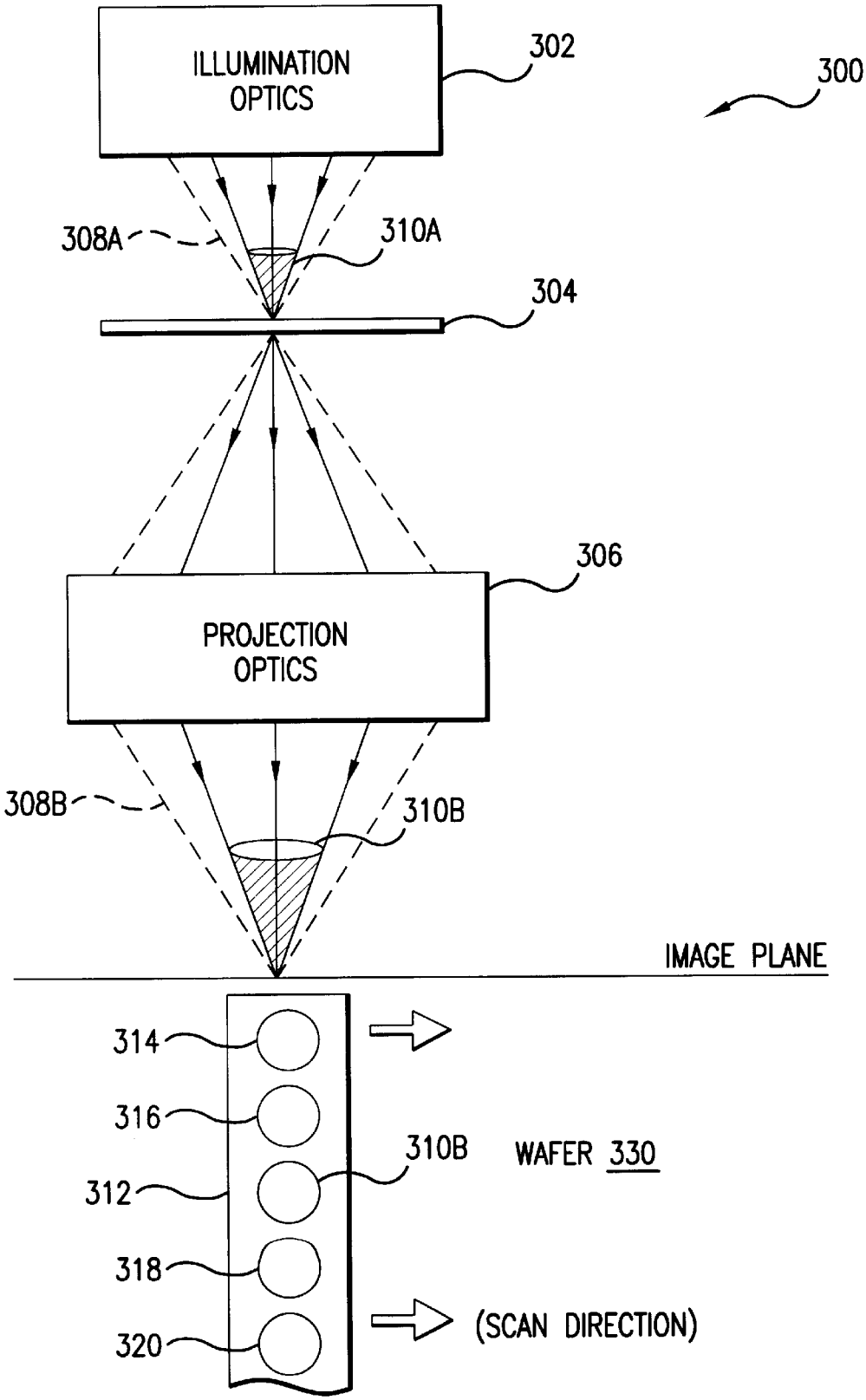
FIG. 3 is an enlarged, perspective view of a holder casing shown in FIG. 1.
Figure 4A:
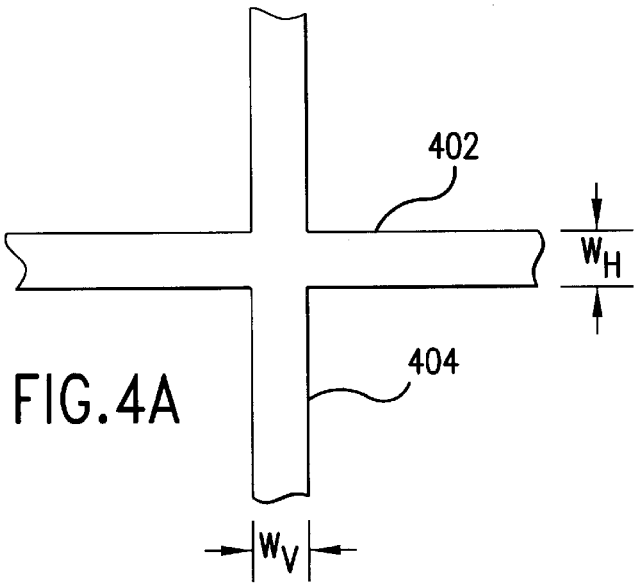
FIG. 4 is an enlarged, perspective view of an electrical connection terminal shown in FIG. 1.
Figure 4B:
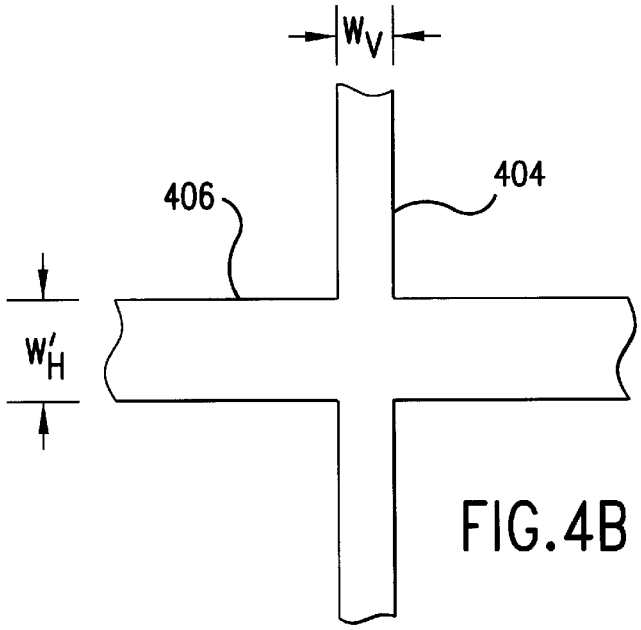
Figure 4C:
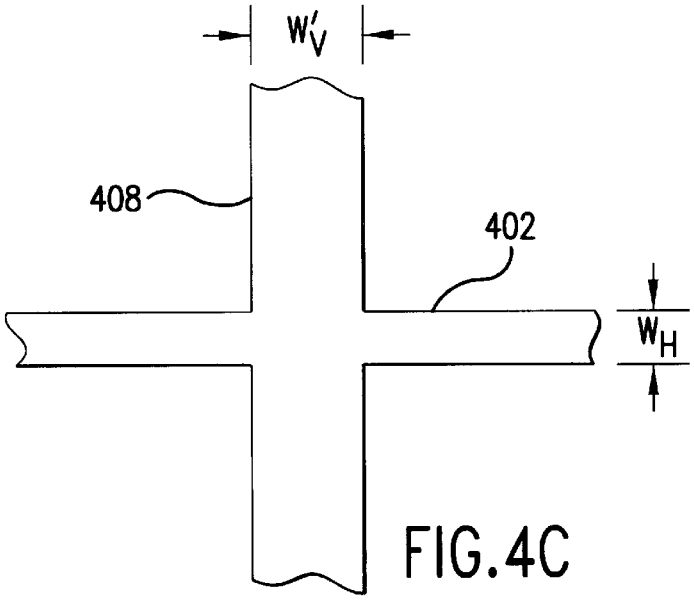

As shown in FIG. 3, the holder casing 27 includes: a holder receiving chamber 27*a* for receiving the flat insertion plate portion 25*a* of the holder body 25, around which the electrical contact portion 24 of the FPC 23 is wound; a housing lock member 27*b,* which can be brought into and out of retaining engagement with a retaining portion 31*b* on the connector housing 31; and holder retaining portions 27*c* for respectively retaining the retaining projections 25*b* of the holder body 25. This holder casing 27 is molded into an integral construction, using an insulative resin.

In this embodiment, a pair of connection holes 23*b* and 23*b* are formed through the end portion of the FPC 23 as shown in FIG. 2, and the pair of retaining projections 25*b* and 25*b,* formed on the insertion-purpose flat plate portion 25*a* of the holder body 25, are passed through these connection holes, respectively.

The FPC 23 is folded back, with the conductors 23*a* exposed outwardly. In this condition, this FPC is wound around the flat insertion plate portion 25*a* in such a manner that this flat plate portion 25*a* of the holder body 25 is inserted in a space formed by the folded-back portion of the FPC. At this time, the retaining projections 25*b* are passed respectively through the connection holes 23*b,* and are retainingly engaged in these holes, respectively.

Then, the flat insertion plate portion 25*a* of the holder body 25, around which the electrical contact portion 24 is wound, is inserted into the holder receiving chamber 27*a,* and the retaining projections 25*b* are retainingly engaged in the holder retaining portions 27*c,* respectively, thereby fixing the holder 26 to the end portion of the FPC 23 (see FIG. 6).

Figure 4:
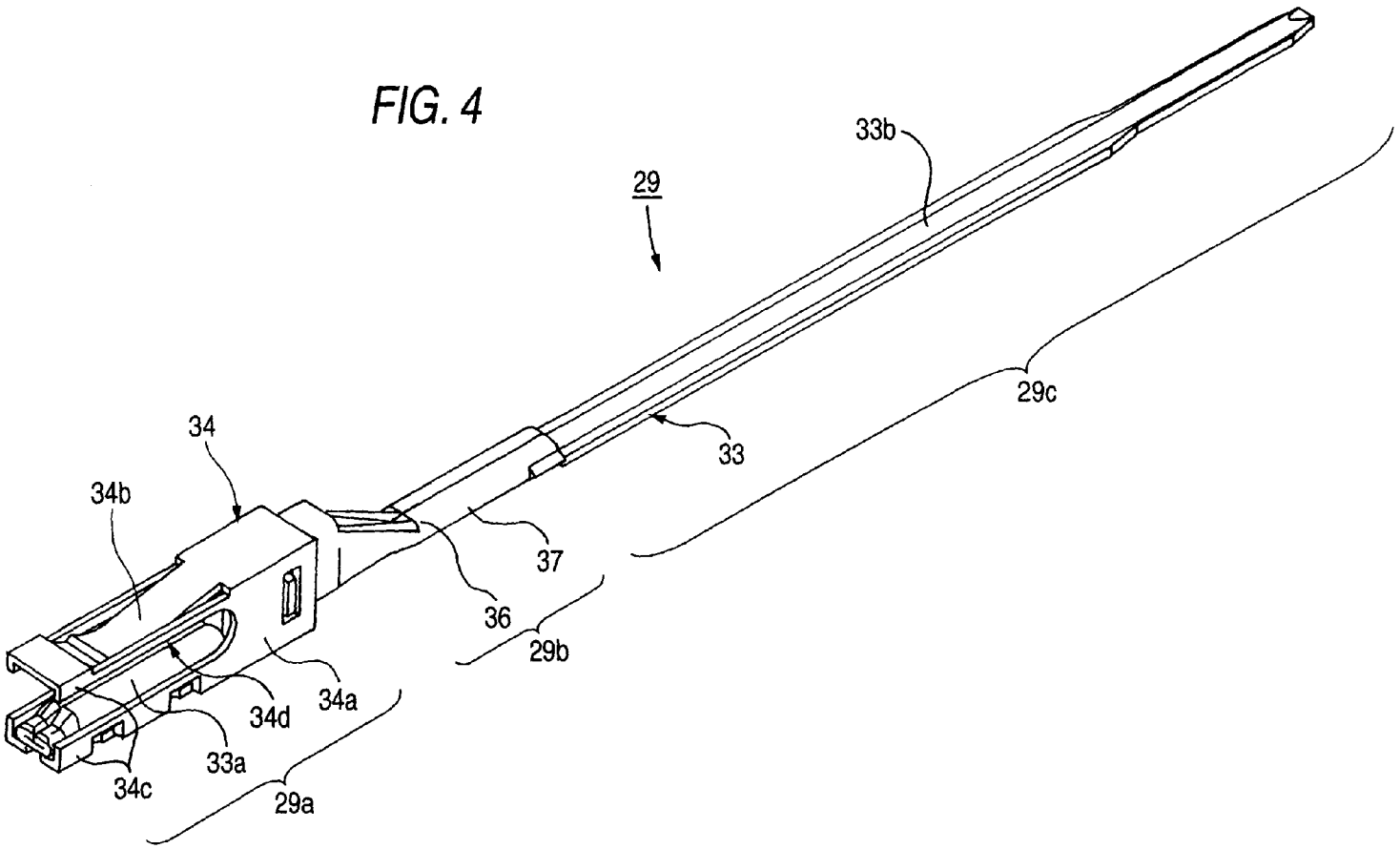
Figure 5:
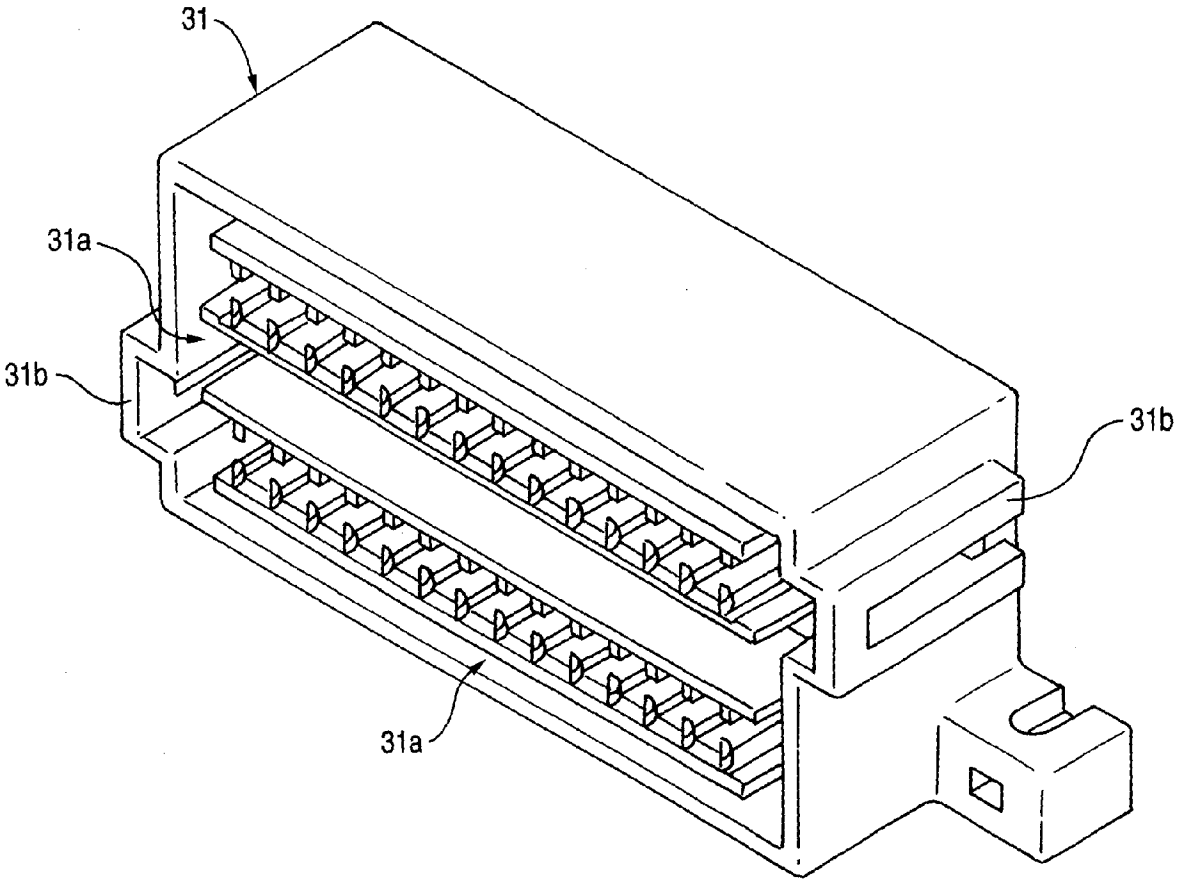
Figure 6:
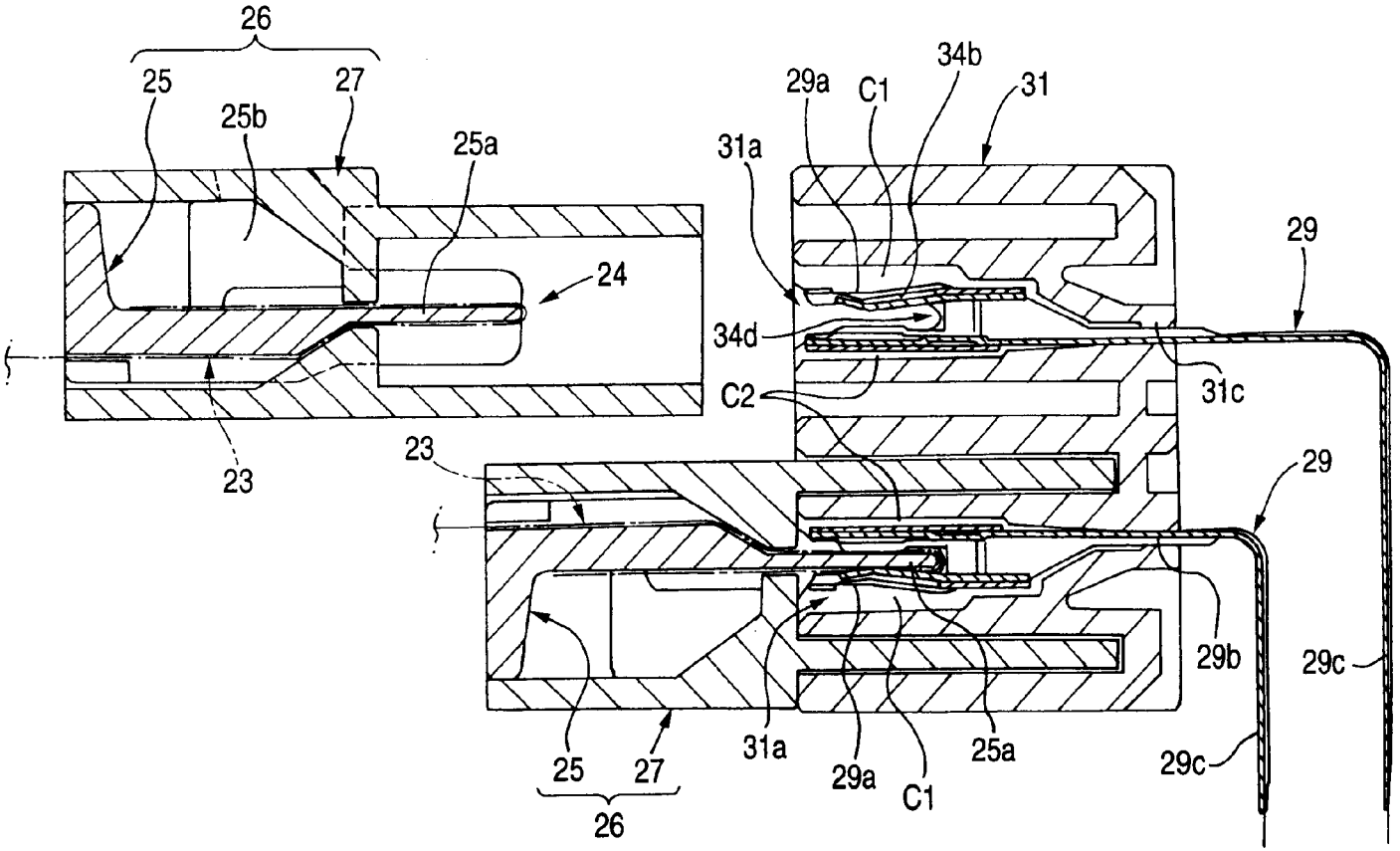
Figure 8:
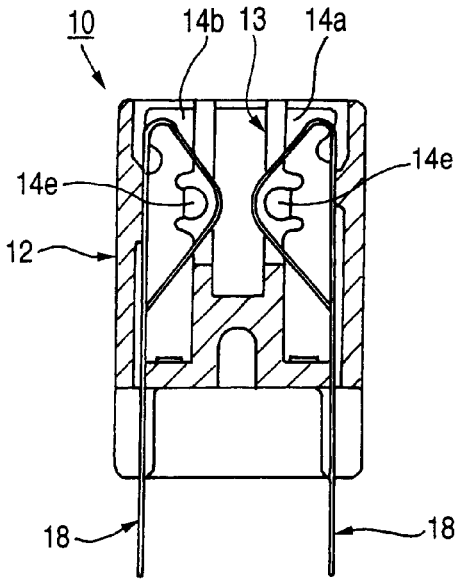
Figure 9:
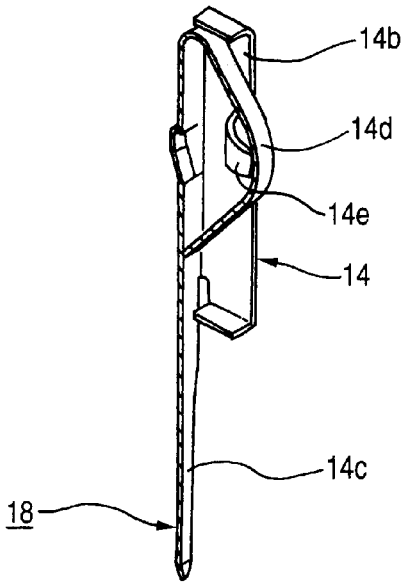
Figure 7:
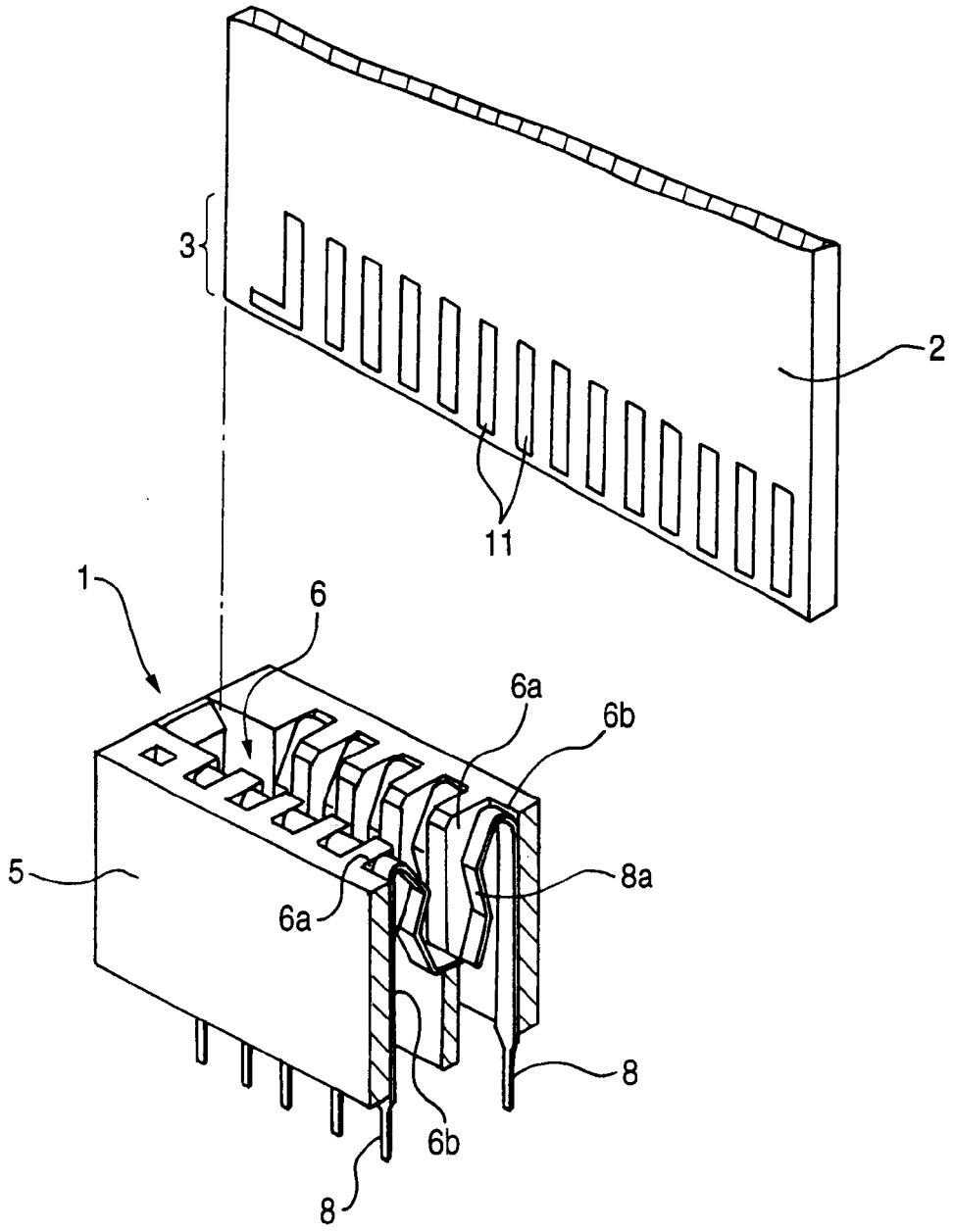

As shown in FIG. 4, each electrical connection terminal 29 is adapted to be received and held in the terminal receiving portion 31*a* of the connector housing 31, and includes: a holding portion 29*a* for holding the conductor 23*a* on the electrical contact portion 24, wound around the front end portion of the flat insertion plate portion 25*a;* a fixing portion 29*b* which extends from the holding portion 29*a* in the direction of insertion of the holder into the connector housing 31 and is fixedly supported by a terminal support portion 31*c* within the terminal receiving portion 31*a;* and a mounting pin portion 29*c* which is inserted into a mounting hole, formed through a printed circuit board (not shown), and then is soldered thereto.

The electrical connection terminal 29 is constituted by two parts, that is, a terminal body 33 and a holding frame body 34 fitted and mounted on a front end portion of this terminal body 33.

The terminal body 33 includes amounting pin 33*b* extending rearwardly from an abutment portion 33*a* for contact with a lower surface of the flat insertion plate portion 25*a,* and this mounting pin of an integral construction, having a bar-like shape, is formed by pressing a metal sheet.

The holding frame body 34 includes: a frame portion 34*a* fitted on a proximal end of the abutment portion 33*a;* a pair of holding piece portions 34*c* and 34*c* extending forwardly respectively from upper and lower edges of the frame portion 34*a* to form a U-shaped slit 34*d;* and a resilient contact piece portion 34*b* which is disposed in opposed relation to the abutment portion 33*a* and can resiliently be contacted with the upper surface of the flat insertion plate portion 25*a*. This holding frame body 34 of an integral construction is formed by pressing a metal sheet.

The electrical contact portion 24 wound around the insertion-purpose flat plate portion 25*a* is fitted into the slit 34*d* in the holding portion 29*a* of the electrical connection terminal 29 such that the abutment portion 33*a* of the terminal body 33 and the resilient contact piece portion 34*b* of the holding frame body 34 hold this electrical contact portion 24 therebetween.

A weak portion 36 for allowing the holding portion 29*a* to be easily pivotally displaced in a holding direction (upward-downward direction in FIG. 4) is formed between the fixing portion 29*b* and holding portion 29*a* of the electrical connection terminal 29.

The weak portion 36 has a portion which is increased in strength by inwardly bending its opposite side edge portions in overlapping relation to its main portion, and a front end of this fixing portion has a generally rectangular cross-section, and therefore the portion is lower in strength than those portions disposed forwardly and rearwardly respectively of this portion.

Therefore, the holding portion 29*a* can be easily pivotally displaced about the weak portion 36 (disposed in the vicinity of the fixing portion 29*b*), serving as a point of pivotal movement, in the holding direction, without excessively deforming the holding frame body 34 and the abutment portion 33*a*.

As shown in FIGS. 5 and 6, the connector housing 31 includes the terminal receiving portions 31*a* arranged in two (upper and lower) rows. The electrical connection terminals 29 are received and held in these terminal receiving portions 31*a,* and the holders 26 can be fitted respectively into the terminal receiving portions 31*a* in the same direction as the direction of the axes of the electrical connection terminals 29. The retaining portions 31*b* are formed respectively on the outer surfaces of the opposite side walls of the connector housing 31, and the housing lock member 27*b* on the holder casing 27 can be brought into and out of retaining engagement with these retaining portions 31*b,* respectively.

As shown in FIG. 6, the terminal support portion 31*c* is formed inside the terminal receiving portion 31 at the inner end portion thereof. The fixing portion 29*b* of the electrical connection terminal 29 is press-fitted into this terminal support portion 31*c,* and is fixedly supported by it.

As shown in FIG. 6, the terminal receiving portion 31*a* is so formed that that clearances C1 and C2 are formed respectively between the upper wall of the terminal receiving portion 31*a* and the holding portion 29*a* of the electrical connection terminal 29 and between the lower wall of the terminal receiving portion 31*a* and the holding portion 29*a* of the electrical connection terminal 29. The clearances C1 and C2 allow the pivotal displacement of the holding portion 29*a* in the holding direction (upward-downward direction in FIG. 6).

Namely, according to the flat circuit member connector 21 of this embodiment, the holding portion 29*a* of each electrical connection terminal 29, received in the terminal receiving portion 31*a* of the connector housing 31, can be pivotally displaced in the holding direction about the pivotal point disposed in the vicinity of the fixing portion 29*b* fixedly supported by the terminal support portion 31*c* of the connector housing 31.

Therefore, even if the holder 26 is inclined relative to the slit 34*d* in the holding portion 29*a* during the time when the front end portion of the flat insertion plate portion 25*a* of the holder 26, around which the electrical contact portion 24 at the end portion of the FPC 23 is wound, is fitted and inserted into the connector housing 31, the holding portion 29*a* can be pivotally displaced in accordance with the direction of insertion of the holder 26. Therefore, the flat insertion plate portion 25*a* of the holder 26 will not cause an excessive rubbing engagement relative to the holding piece portions 34*c* and 34*c* of the holding portion 29*a*.

Therefore, when the holder is inserted, an excessive force will not act on the holding piece portions 34*c* and 34*c* of the holding portion 29*a,* so that the deformation of the holding portion 29*a* can be prevented.

Even when part of the flat insertion plate portion 25*a* of the inserted holder 26 is contacted hard with the holding portions 29*a* of the corresponding electrical connection terminals 29 because of variations in the dimensional accuracy of the electrical connection terminals 29 received in the terminal receiving portion 31*a* of the connector housing 31 and variations in the accuracy of positioning of the electrical connection terminals 29 in the terminal receiving portion 31*a,* the relevant holding portions 29*a* can be pivotally displaced in accordance with the direction of the flat insertion plate portion 25*a* of the holder 26. Therefore, the insertion-purpose flat plate portion 25*a* of the holder 26 will not cause an excessive rubbing engagement relative to these holding portions 29*a*.

Namely, the elimination of the excessive rubbing engagement of the electrical connection terminal 29 is achieved by the pivotal displacement of the holding portion 29*a* about the weak portion 36 (serving as the pivotal movement) of the electrical connection terminal 29, and does not depends on the resilient deformation of the holding portion 29*a* itself. Therefore, the inserting pressure, required when inserting the insertion-purpose flat plate portion 25*a* of the holder 26 into the holding portions 29*a* of the electrical connection terminals 29, is generally uniform over all of the electrical connection terminals 29 received in the terminal receiving portion 31*a,* and variations of the inserting pressure due to the excessive rubbing engagement will not occur.

Therefore, there can be obtained the good inserting operation for inserting the holder 26 into the terminal receiving portion 31*a* of the connector housing 31.

The holding portion 29*a* of the electrical contact terminal 29, holding the flat insertion plate portion 25*a* of the holder 26, will not be contacted hard with this flat insertion plate portion 25*a*. Therefore, the holding portion 29*a* will not be excessively deformed, and each holding portion 29*a* can contact the conductor 23*a* on the FPC 23, wound around the insertion-purpose flat plate portion 25*a* of the holder 26, within the predetermined resilient deformation range.

Therefore, the characteristics of electrical connection between the holding portion 29*a* of the electrical connection terminal 29 and the conductor 23*a* of the FPC 23 will not be degraded.

The constructions of the electrical connection terminals, the flat circuit members, the connector housing and the holder of the flat circuit member connector of the invention are not limited to those of the above embodiment, and various forms can be adopted based on the spirits of the invention.

For example, the weak portion 36, formed at the electrical connection terminal 29, is not limited to its construction of the above embodiment, and this weak portion may be formed by a constricted portion, a thinned portion or the like, slightly lower in strength than the other portion, so that it can be easily bent upon application of an external force on the holding portion. In the case where the sufficient pivotal displacement of the holding portion of the electrical connection terminal can be secured, for example, by suitably determining the dimensions of the terminal support portion of the connector housing, there may be provided a construction in which the provision of the weak portion is omitted.

As described above, in the flat circuit member connector according to the present invention, the holding portion of each electrical connection terminal, received in the terminal receiving portion of the connector housing, can be pivotally displaced in the holding direction about the pivotal point disposed in the vicinity of the fixing portion fixedly supported by the terminal support portion of the connector housing.

Therefore, even if the holder is inclined relative to the holding portion during the time when the front end portion of the holder, around which the electrical contact portion of the flat circuit member is wound, is fitted and inserted into the connector housing, the holding portion can be pivotally displaced in accordance with the direction of insertion of the holder. Therefore, the front end portion of the holder will not cause an excessive rubbing engagement relative to the holding portion.

On the other hand, even when part of the front end portion of the inserted holder is contacted hard with the holding portions of the corresponding electrical connection terminals because of variations in the dimensional accuracy of the electrical connection terminals (received in the terminal receiving portion of the connector housing) and variations in the accuracy of positioning of the electrical connection terminals in the terminal receiving portion, the relevant holding portions can be pivotally displaced in accordance with the direction of the front end portion of the holder. Therefore, the front end portion of the holder will not cause an excessive rubbing engagement relative to these holding portions.

Namely, the elimination of the excessive rubbing engagement of the electrical connection terminal is achieved by the pivotal displacement of the holding portion about the pivotal point near to the fixing portion of the electrical connection terminal, and does not depend on the resilient deformation of the holding portion itself. Therefore, the inserting pressure, required when inserting the front end portion of the holder into the holding portions of the electrical connection terminals, is generally uniform over all of the electrical connection terminals received in the terminal receiving portion, and variations of the inserting pressure due to the excessive rubbing engagement will not occur.

The holding portion of the electrical contact terminal, holding the front end portion of the holder, will not be contacted hard with this front end portion. Therefore, the holding portion will not be excessively deformed, and each holding portion can contact the conductor on the flat circuit member, wound around the front end portion of the holder, within the predetermined resilient-deformation range.

Therefore, there can be provided the flat circuit member connector which prevents the deformation of the electrical connection terminals, received in the terminal receiving portion of the connector housing, and has the good electrical connection characteristics and fitting operability.

What is claimed is:

1. A flat circuit member connector comprising:

a connector housing;

a terminal receiving portion provided within the connector housing and including a terminal support portion;

an electrical connection terminal inserted into and received in the terminal receiving portion in an insertion direction, the electrical connection terminal including, a holding portion disposed in the terminal receiving portion so that a clearance for allowing a displacement of the holding portion in a holding direction is formed between the holding portion and the terminal receiving portion, and a fixing portion supported by the terminal support portion and extending from the holding portion in the insertion direction, a flexible flat circuit member including at an end portion thereof an electrical contact portion to which a conductor is exposed; and a holder which holds the flexible flat circuit member which is wound around an end portion of the holder, and is held by the holding portion in the holding direction so that the electrical contact portion is electrically connected to the electrical connection terminal when the holder is inserted into the connector housing in the insertion direction, wherein a weak portion for allowing a pivotal displacement of the holding portion in the holding direction is formed between the fixing portion and the holding portion, and wherein the holding portion comprises:

a frame portion, a first holding piece extending from an upper edge of the frame portion, and a second holding piece extending from a lower edge of the frame portion.

2. The flat circuit member connector according to claim 1, wherein a plurality of the terminal receiving portions for respectively receiving a plurality of the electrical connection terminals are provided to the connector housing and are aligned in a direction substantially perpendicular to the holding direction.

3. The flat circuit member connector according to claim 1, wherein the first holding piece and second holding piece are disposed in the terminal receiving portion so that the clearance is formed between the first holding piece and an inner wall of the terminal receiving portion and between the second holding piece and the inner wall of the terminal receiving portion.

4. The flat circuit member connector according to claim 1, wherein the holding portion further comprises a resilient contact piece coupled to the frame portion.

5. The flat circuit member connector according to claim 4, wherein the holding portion further comprises an abutment portion coupled to the frame portion and disposed in opposed relation to the resilient contact piece, wherein the abutment portion and the resilient contact piece are operable to hold the electrical contact portion to which a conductor is exposed.

6. A connector comprising:

a connector housing;

a terminal receiving portion provided within the connector housing and including a terminal support portion;

an electrical connection terminal inserted into and received in the terminal receiving portion in an insertion direction, the electrical connection terminal including, a holding portion disposed in the terminal receiving portion so that a clearance for allowing a displacement of the holding portion in a holding direction is formed between the holding portion and the terminal receiving portion, and a fixing portion supported by the terminal support portion and extending from the holding portion in the insertion direction, wherein a weak portion for allowing a pivotal displacement of the holding portion in the holding direction is formed between the fixing portion and the holding portion, and wherein the holding portion comprises:

a frame portion, a first holding piece extending from an upper edge of the frame portion, and a second holding piece extending from a lower edge of the frame portion.

7. The flat circuit member connector according to claim 6, wherein a plurality of the terminal receiving portions for respectively receiving a plurality of the electrical connection terminals are provided to the connector housing and are aligned in a direction substantially perpendicular to the holding direction.

8. The flat circuit member connector according to claim 6, wherein the first holding piece and second holding piece are disposed in the terminal receiving portion so that the clearance is formed between the first holding piece and an inner wall of the terminal receiving portion and between the second holding piece and the inner wall of the terminal receiving portion.

9. The flat circuit member connector according to claim 6, wherein the holding portion further comprises a resilient contact piece coupled to the frame portion.

10. The flat circuit member connector according to claim 9, wherein the holding portion further comprises an abutment portion coupled to the frame portion and disposed in opposed relation to the resilient contact piece, wherein the abutment portion and the resilient contact piece are operable to hold an electrical contact portion to which a conductor is exposed.

* * * * *

UNITED STATES PATENT AND TRADEMARK OFFICE

CERTIFICATE OF CORRECTION

PATENT NO. : 6,558,187 B2
DATED : May 6, 2003
INVENTOR(S) : Hiroshi Aoki

It is certified that error appears in the above-identified patent and that said Letters Patent is hereby corrected as shown below:

Title page showing the illustrative figure should be deleted to be replaced with the attached title page.

Drawing sheets, consisting of Figs. 1 through 9B, should be deleted to be replaced with the drawing sheets, consisting of Figs. 1 through 9, as shown on the attached pages.

Signed and Sealed this

Fourteenth Day of September, 2004

JON W. DUDAS
*Director of the United States Patent and Trademark Office*

(12) United States Patent
Aoki

(10) Patent No.: US 6,558,187 B2
(45) Date of Patent: May 6, 2003

(54) CONNECTOR FOR FLAT CIRCUIT MEMBER

(75) Inventor: Hiroshi Aoki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/079,869

(22) Filed: Feb. 22, 2002

(65) Prior Publication Data

US 2002/0142647 A1 Oct. 3, 2002

(30) Foreign Application Priority Data

Feb. 22, 2001 (JP) ..... 2001-046847

(51) Int. Cl.[7] ..... H01R 12/24
(52) U.S. Cl. ..... 439/496
(58) Field of Search ..... 439/496, 246, 439/495, 67, 77

(56) References Cited

U.S. PATENT DOCUMENTS 3,696,319 A * 10/1972 Olsson ..... 439/496
5,194,017 A 3/1993 Consoli
5,451,172 A 9/1995 Lee Siew Suan et al.

FOREIGN PATENT DOCUMENTS

EP 0 743 715 A2 11/1996

* cited by examiner

*Primary Examiner*—Gary Paumen
(74) *Attorney, Agent, or Firm*—Sughrue Mion, PLLC

(57) ABSTRACT

A flat circuit member connector (21) includes electrical connection terminals (29) received and held in a terminal receiving portion (31*a*) of a connector housing, and a holder (26) which holds an electrical contact portion (24) of an FPC, wound around its flat insertion plate portion (25*a*), and can bring conductors of the electrical contact portion into contact with the electrical connection terminals (29), respectively. The electrical connection terminal includes a holding portion (29*a*) for holding the electrical contact portion, wound around the flat insertion plate portion, when the holder is inserted into the connector housing. The holding portion is received in the terminal receiving portion, with clearances (C1 and C2) formed between the holding portion and an inner wall of the terminal receiving portion, so that the holding portion can be pivotally displaced in a holding direction.

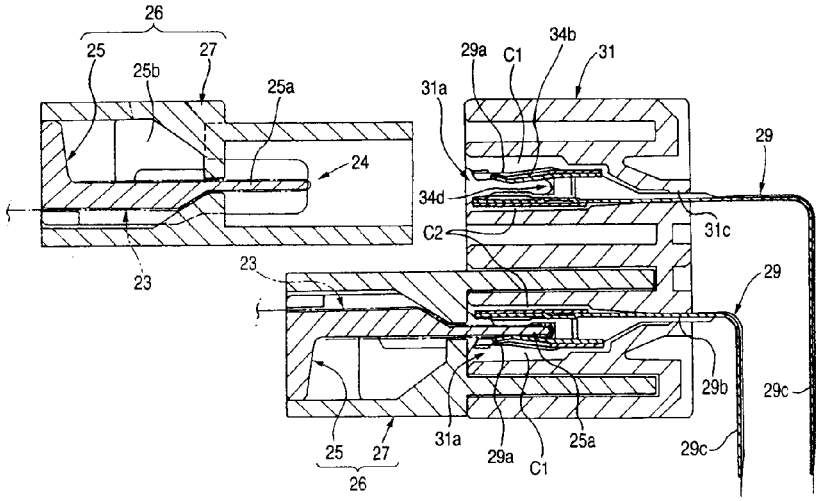

10 Claims, 10 Drawing Sheets